United States Patent [19]

Tanaka

[11] Patent Number: 4,694,791

[45] Date of Patent: Sep. 22, 1987

[54] STARTING DEVICE WITH AIR MOTOR FOR INTERNAL COMBUSTION ENGINES

[75] Inventor: Masami Tanaka, Osaka, Japan

[73] Assignee: Showa Precision Machinery Co., Ltd., Amagasaki, Japan

[21] Appl. No.: 845,760

[22] Filed: Mar. 25, 1986

[30] Foreign Application Priority Data

Nov. 15, 1985 [JP] Japan ..... 60-257139

[51] Int. Cl.[4] ..... F02N 7/08

[52] U.S. Cl. ..... 123/179 F; 60/627; 91/53

[58] Field of Search ..... 123/179 F; 60/625, 626, 60/627; 91/53

[56] References Cited

U.S. PATENT DOCUMENTS

| | | | |
|---|---|---|---|
| 2,953,127 | 9/1960 | Adams et al. | 123/179 F |
| 3,094,845 | 6/1963 | Mallofré | 91/53 |
| 3,182,650 | 5/1965 | Heckt | 123/179 F |
| 3,791,365 | 2/1974 | Pharr et al. | 123/179 F |
| 3,794,009 | 2/1974 | Wenrich et al. | 123/179 F |

*Primary Examiner*—Andrew M. Dolinar

*Attorney, Agent, or Firm*—Millen & White

[57] ABSTRACT

A starter for internal combustion engines comprising a driving shaft to be driven by the air motor, a main valve for controlling the flow of compressed air to the air motor, and an air piston to advance the driving shaft to a position for starting the engine. Before feeding compressed air through the main valve to the air motor, a branched stream of compressed air is fed through a sub-valve to the air motor to rotate it at low speed and also to the main valve and the air piston to actuate them.

4 Claims, 3 Drawing Figures

STARTING DEVICE WITH AIR MOTOR FOR INTERNAL COMBUSTION ENGINES

BACKGROUND OF THE INVENTION

1. Field of the Invention

The present invention relates to a starting device with an air motor for internal combustion engines, and more particularly it relates to a control device for said starting device.

2. Description of the Prior Art

Starting devices with an air motor for internal combustion engines have been known as they are disclosed, for example, in Japanese Patent Publication Nos. 35894/1973 and 21101/1983 and U.S. Pat. No. 4,126,113. Such starting device has a pinion which is mounted on the front end of a driving shaft and adapted to advance while rotating, said pinion meshing with the ring gear of an internal combustion engine to start said internal combustion engine, the operation thereof being such that an air piston fitted to said driving shaft is advanced by a branch flow of compressed air, thereby advancing said driving shaft, and then a large amount of compressed air is fed to an air motor to rotate the latter at high speed, thereby causing the pinion of said driving shaft to start the internal combustion engine.

And the conventional starting device with an air motor uses a solenoid valve as its start command valve and is so arranged that in separating the pinion of said driving shaft from said ring gear after said internal combustion engine has been started, said solenoid valve is used.

In such case, after the starting of the internal combustion engine, if the cut-off operation of the solenoid valve is delayed, said air motor is accelerated to 10 or more times by the rotation of the engine itself at the start, so that in the worst case, it would be damaged.

For this reason, the conventional starting device uses members for a torque limiter or overrun clutch, but these members often get damaged; thus, I have already made a proposal which solves this problem in Japanese Utility Model Application No. 124478/1984. That is, after the internal combustion engine has been started by the air motor, the rotative speed of the ring gear becomes higher than that of the pinion and hence the driving shaft of the pinion is accelerated. Thus, said driving shaft is formed with screw splines and said accelerating force rotates said splines to retract the driving shaft and air piston. As a result, the mechanical valve which actuates the main valve is closed. In this case, the compressed air being fed to the air piston is cut off, so that even if the start command valve is not cut off, there is no danger of the pinion being inadvertently advanced again. This is my proposal.

However, when said conventional technique and such proposal were tested, a new problem arose. That is, the amount of compressed air for advancing the air piston and rotating the air motor gradually at low speed is small, resulting in the lack of air piston pressing force and air motor low-speed rotating force, a fact which is undesirable for the starting device which is expected to meet the need of starting the engine "at one stroke." Thus, it could be thought to increase the diameter of the pipe for feeding compressed air, but an increase in the pipe diameter would result in an increase in rigidity, making piping operation more difficult, requiring more space for installation and adding to weight.

SUMMARY OF THE INVENTION

Accordingly, the present invention, which has been accomplished to solve such problems, is intended to reliably start the starting device by feeding large amounts of compressed air for the air piston and gear motor for low speed rotation.

The invention will now be described in more detail with reference to the accompanying drawings showing an embodiment thereof.

DESCRIPTION OF THE PREFERRED EMBODIMENTS

Figure 2:
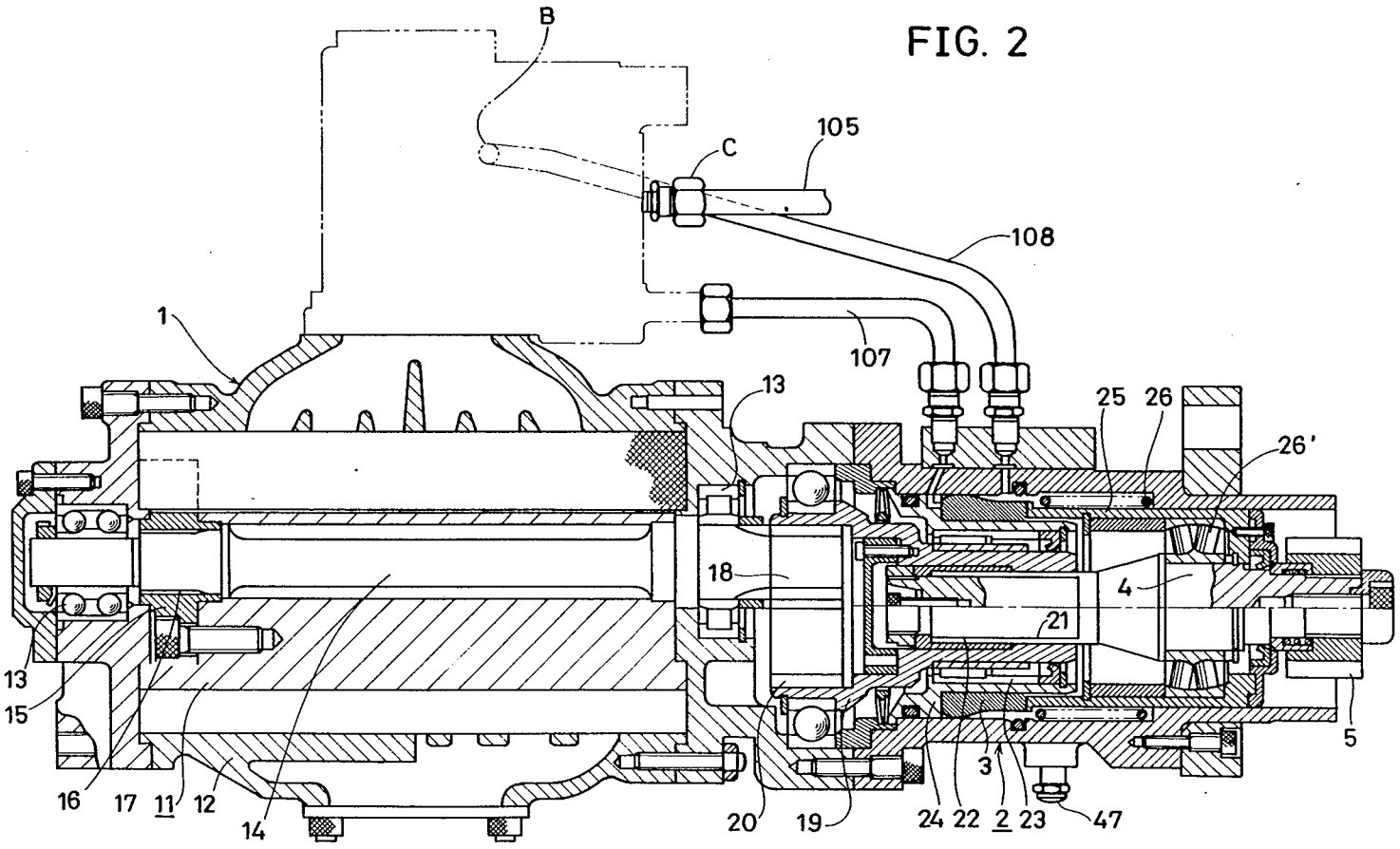
FIG. 2 is a sectional view of said embodiment in its entirety.

The outline of the embodiment will first be described. In FIG. 2, an air motor 1 is integral with a piston housing 2 in which an air piston 3 is contained, and a driving shaft 4 driven by said air motor 1 is horizontally mounted in said piston housing 2. A pinion 5 is provided on the front end of said driving shaft 4 and is adapted to engage and disengage the ring gear of an unillustrated internal combustion engine.

Figure 3:
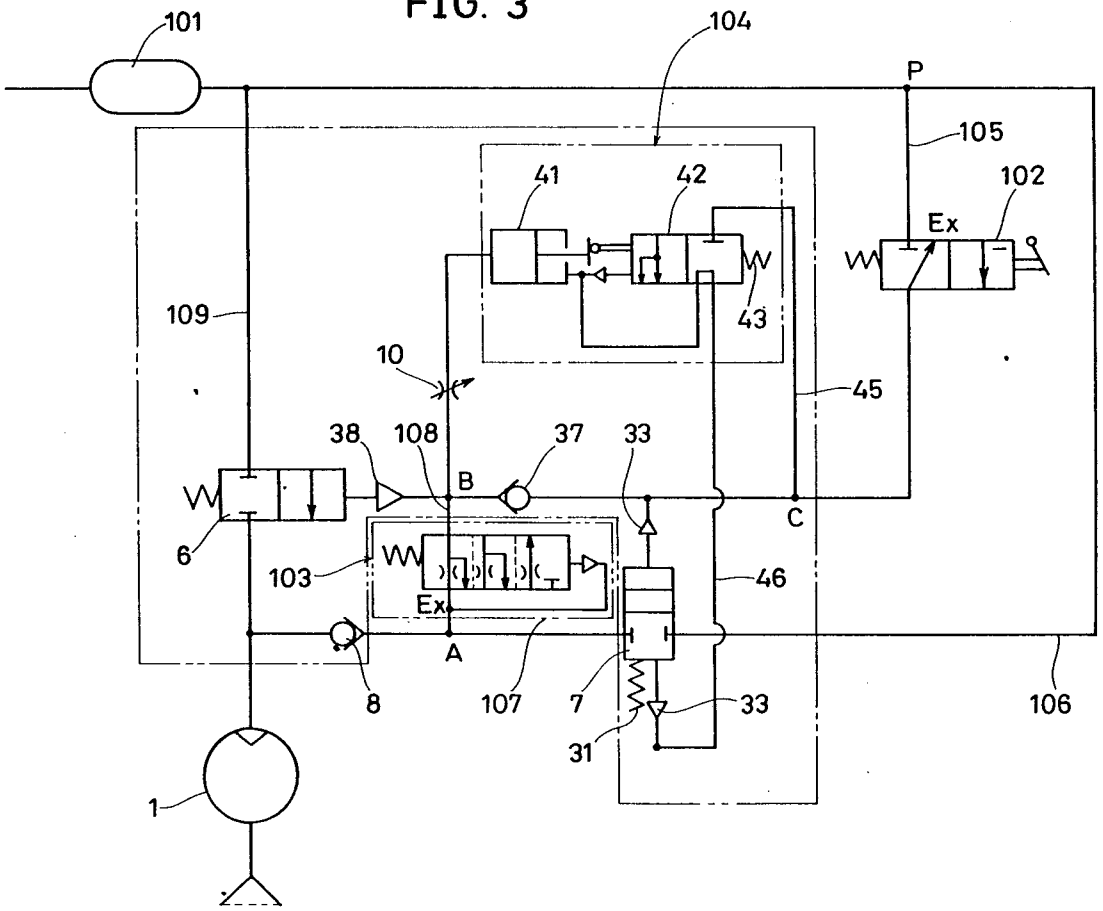
FIG. 3 is an air circuit diagram of said embodiment.

The outline of the control is shown in FIG. 3, wherein said air motor 1 is adapted to be rotated at high speed by compressed air fed from an air tank 101, and disposed between said air motor 1 and said air tank 101 are a main valve 6, a sub-valve 7 and a start command valve 102. Compressed air from the air tank 101 is constantly fed to the main valve 6 and sub-valve 7. Thus, when the start command valve 102, which is placed in a first passage 105 and which is formed, e.g., of a solenoid valve, is opened, the compressed air passing through said start command valve 102 acts to open the sub-valve 7 through a point C. As a result, the compressed air from the air tank 101 flows through a communication passage 106 and then through the sub-valve 7 and into a point A. At the point A, part of the compressed air flows through a check valve 8 and is fed to the air motor 1 to rotate the latter at slow speed. At the same time, the remaining compressed air flows through a second passage 107 and advances the air piston 3 (which, in FIG. 3, is shown surrounded by a frame 103), causing the pinion 5 to mesh with the ring gear 5, whereupon the compressed air is fed to a third passage 108, flowing through a point B to open the main valve 6. When the main valve 6 is opened, a large amount of compressed air from the air tank 101 is fed to the air motor 1 to rotate the latter at high speed, thereby causing the pinion 5 to start the internal combustion engine. On the other hand, the compressed air at the point B actuates a start signal retention valve 104 through a throttle needle valve 10. As a result, the compressed air at the aforesaid point C closes the sub-valve 7 via the start signal retention valve 104. Therefore, even if the start command valve 102 is in its closed state, there is no possibility of advancing the air piston 3 again or inadvertently advancing the pinion 5.

(Arrangement of Air Motor)

The detail of the air motor 1 in the above embodiment is as follows.

In FIG. 2, the air motor 1 comprises a rotor 11 having a plurality of vanes, said rotor 11 being contained in the main valve 12. The rotor 11 is supported at its opposite ends by a rotor shaft 14 through bearings 13. The rotor shaft 14 is constructed as a torsion shaft and is connected at one end thereof to splines 16 by a coupling 15 which is integrally connected to said rotor 11 by bolts 17. The other end of the rotor shaft 14 beyond the bearing 13 is formed with a pinion 18. The pinion 18 meshes with an internal gear 20 formed around the inner periphery of a sleeve shaft 19, thereby constituting a speed reducing mechanism. The inner periphery of said sleeve shaft 19 is formed with screw splines 21 along with said internal gear 20, said screw splines 21 meshing with screw splines 22 formed on the driving shaft 4. These screw splines 21 and 22 are formed of twisted splines in the form of screws (whose lead angle is preferably within the range of 20°–75°) so designed that when the pinion 5 is acted upon by a force which tends to stop the rotation thereof, the driving shaft 4 is caused to advance. In other words, the driving shaft 4, when acted upon by a force which tends to advance it, tends to be reversely rotated, thus decelerating the pinion 5. Further, if an accelerating force acts on the pinion 5, the driving shaft 4 is retracted. The sleeve shaft 19 has a cylinder 24 fitted thereon through a needle bearing 23, and the doughnut-like air piston 3 is slidably installed in a doughnut-like space defined by said cylinder 24 and piston housing 2.

The air piston 3 is normally rearwardly pressed by a piston spring 26 through a sleeve 25. The sleeve 25 is integral with the outer race of a bearing 26'. The inner race of said bearing 26' is integral with the driving shaft 4. Thus, the sleeve 25 and driving shaft 4 are integrally movable back and forth but the sleeve 25 is not rotated by the driving shaft 4.

(Arrangement of Main Valve, Sub-Valve and Start Signal Retention Valve)

The details of main valve 6, sub-valve 7 and start signal retention valve 104 are as follows.

Figure 1:
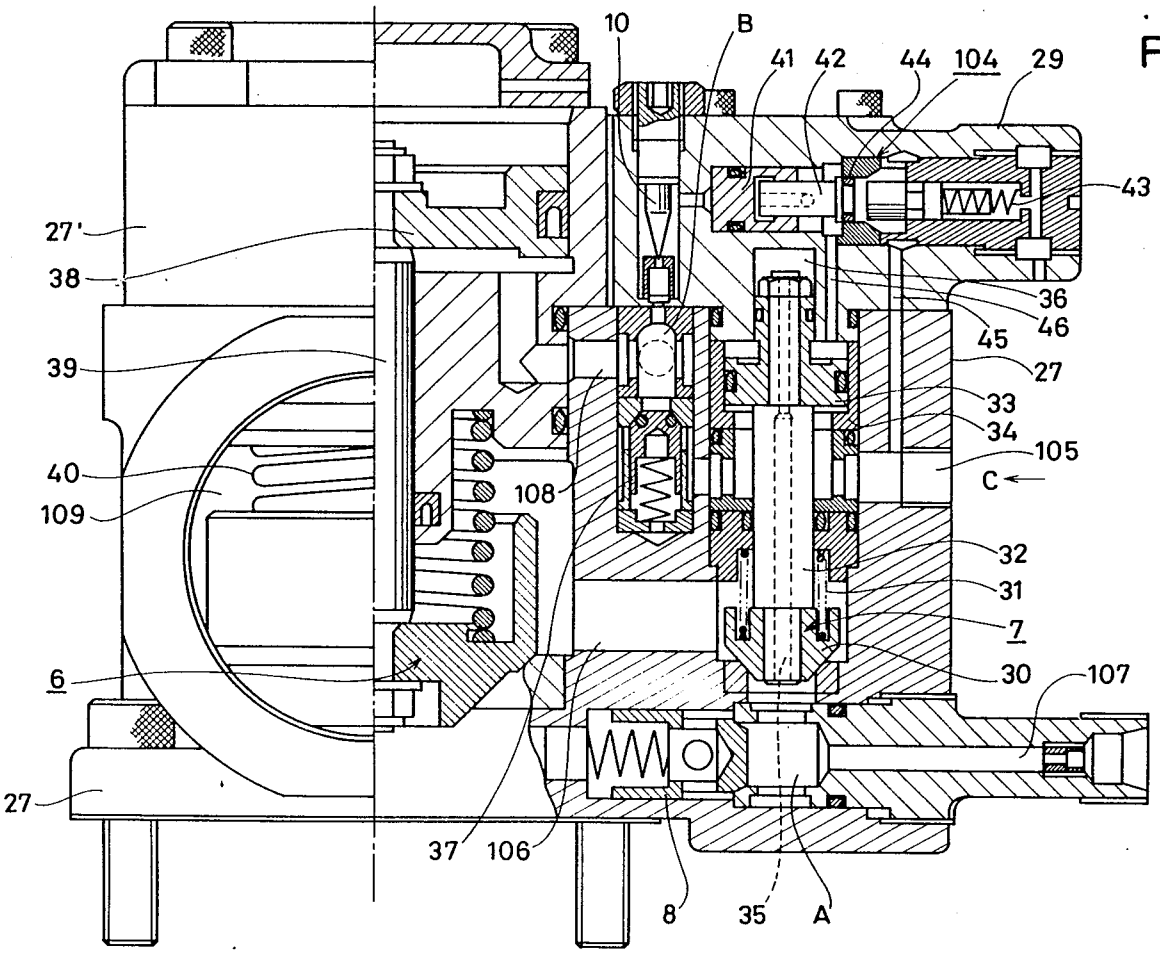
FIG. 1 is an enlarged sectional view of the principal portion of an embodiment of the invention.

In FIG. 1, these valves 6, 7 and 104 are mounted on the main valve 12. That is, the main valve 6 is contained in a main valve cylinder 27', the sub-valve 7 is contained in a valve housing 27, and the start signal retention valve 104 is contained in a start signal retention valve body 29, said cylinder and housings 27', 27 and 29 being integrated together and mounted on the main housing 12. The valve housing 27 has connected thereto a main passage 109, the first passage 105, the second passage 107 and the third passage 108.

The first and second passages 105 and 107 communicate with each other through the sub-valve 7 and the communication passage 106 communicating with the main passage 109. The body 30 of the sub-valve 7 is constantly closed by a sub-valve spring 31. The body 30 has a spindle 32 fitted therein, the upper end of said spindle 32 having a sub-valve piston 33 fixed thereon. The sub-valve piston 33 is vertically slidably fitted in a sub-valve cylinder 34. The spindle 32 is formed with a throughgoing hole 35, which establishes the communication between the upper end 36 of the spindle 32 and the second passage 107. The body 30 is installed in the communication hole 106. On the other hand, said sub-valve cylinder 34 communicates with the first passage 105 so that the compressed air in the first passage 105 presses the lower surface of the sub-valve piston 33. The terminal end of the first passage 105 is provided with a check valve 37 through which it communicates with the third passage 108.

The point B in the third passage 108 communicates with a main valve piston 38. The main valve piston 38 is connected to the main valve 6 by a main valve spindle 39, said main valve 6 communicating with the main passage 109. The main valve 6 is constantly closed by a main valve spring 40.

The point B in the third passage 108 communicates with a needle valve 10 contained in the start signal retention valve body 29. The needle valve 10 communicates with the free piston 41 of the start signal retention valve 104.

The start signal retention valve 104 comprises the free piston 41, a spool valve 42 adapted to be slid by said free piston 41, and a start signal retention valve spring 43 for urging said spool valve 42 toward the free piston 41. The free piston 41 communicates with the needle valve 10 and is pressed by the compressed air in the third passage 108. An O-ring 44 is placed intermediate between the ends of said spool valve 42. At one side of the O-ring 44 there is a passage 45 communicating with the first passage 105 and at the other side there is a communication hole 46 communicating with the upper surface of the sub-valve piston 33. In addition, the numeral 47 in FIG. 2 denotes a vent valve communicating with the third passage 108 and opening to the atmosphere.

With the present embodiment arranged in the manner described above, it operates as follows.

(Meshing between Pinion and Ring Gear)

When the start command valve 102 is opened, compressed air from the air tank 101 flows through the first passage 105 and into the sub-valve cylinder 34 to slide the sub-valve piston 33 upwardly against the force of the sub-valve spring 31. As a result, the sub-valve 7 is opened, so that the compressed air fed up to the communication passage 106 is fed to the second passage 107 and also to the check valve 8. Part of the compressed air fed to the second passage 107 advances the air piston 3 against the force of the piston spring 26. As a result, the driving shaft 4 integral with said air piston 3 also gradually advances while being reversely rotated by the action of the screw splines 21 and 22, until the pinion 5 abuts against the ring gear.

On the other hand, when part of the compressed air throttled by the sub-valve 7 is fed to the air motor 1 through the check valve 8, the air motor 1 begins to rotate at low speed. The low speed rotation of the rotor 11 is further reduced by the pinion 18 and internal gear 20 and then transmitted to the screw splines 22 of the driving shaft 4. The pinion 5 is rotated at a further reduced speed by the action of the screw splines 21 and 22. Then, the pinion 5 and ring gear partly engage each other while slipping at the lateral surfaces of the teeth. When partial meshing engagement is thus made, the rotation of the pinion 5 is prevented by the ring gear, which is at rest, so that this preventive force acts on the screw splines 21 and 22 and the driving shaft 4 is rotated faster than the forward travel speed of the air piston; thus, the meshing between the pinion 5 and the ring gear is completely effected.

(Closing Operation of Main Valve)

At the position where the pinion 5 and the ring gear completely mesh with each other and the driving shaft 4 stops its forward travel, the second and third passages 107 and 108 communicate with each other through the doughnut-like space defined by the cylinder 24 and the piston housing 2. Subsequently, the compressed air in the second passage 107 is fed to the main valve piston 38 from the point B through the third passage 108. As a result, the main valve piston 38 is slid upwardly to open the main valve 6. Therefore, a large amount of compressed air from the air tank 101 is fed to the rotor 11 via the communication passage 109, thereby rotating the rotor 11 at high speed.

(Locking Operation of Sub-Valve)

Substantially at the same time as the compressed air in the third passage 108 is fed to the point B to open the main valve 6, it is also fed to the needle valve 10, thereby sliding the free piston 41 with some time lag to the right as viewed in FIG. 1 against the force of the start signal retention valve spring 43. As a result, the spool valve 42 is slid in the same direction, so that the compressed air flows through the first passage 105 and communication passage 46 to depress the upper surface of the sub-valve piston 33. Then, since the upper and lower surface of the sub-valve piston 33 are subjected to the same pressure of the compressed air in the first passage 105, the sub-valve 7 is closed by the force of the sub-valve spring 31. At this time, even if the air pressure in the third passage 108 lowers, the spool valve 42 will not slide since the free piston 41 is free. That is, the sub-valve 7 is locked.

(Closing Operation of Main Valve)

The internal combustion engine is started by the high speed rotation of the rotor 11, and the rotation of the internal combustion engine itself results in the pinion 5 being rotated faster, with the action of the screw splines 21 and 22 retracting the driving shaft 4, and the force of the piston spring 26 also acts in addition thereto, so as to retract the driving shaft 4 quickly. Therefore, the pinion 5 is separated from the ring gear. With the retraction of the driving shaft 4, the air piston 3 is also retracted, with the result that the second and third passages 107 and 108 are cut off by the air piston 3, so that the compressed air in the third passage 108 is discharged into the atmosphere at once through the vent valve 47. Therefore, the main valve piston 38 is quickly lowered, closing the main valve 6.

In addition, when the operator opens the start command valve 102 to start the internal combustion engine, the compressed air in the third passage 108 is discharged into the atmosphere at once through the vent valve 47, as described above, but if the internal combustion engine fails to start, the compressed air in the third passage 108 will remain as it is. Thus, if the operator once closes the start command valve 102, then the compressed air in the first passage 105 is discharged into the atmosphere through the said start command valve 102. Thus, since the compressed air in the third passage 108 is discharged into the atmosphere from the first passage 105 through the check valve 37, the main valve 6 is quickly closed.

In addition, while the present starting device is suitable for use with vehicle diesel engines and stationary gas turbines, it is particularly suitable for use with large-sized internal combustion engines (300–1600 KW). Further, the pinion 5 may be replaced by suitable splines.

The present invention constructed in the manner described above has the following effects.

(1) Since part of the compressed air for the air motor is used for closing the air motor main valve, the cost is low and even if the present starting device is used at any location, the air motor is easy to maintain.

(2) Since compressed air fed to the air motor main valve is used in large amounts for rotating the air motor at low speed and advancing the driving shaft, these actions can be brought about smoothly. In addition, if the separate passage piping leading from the air tank is dispensed with, the labor, weight and space associated with the piping can be saved.

(3) Since large amounts of compressed air can be used for both pressing the driving shaft advancing air piston and rotating the air motor at low speed, the so-called at-one-stroke start required by internal combustion engine starting devices can be positively attained, a fact which is desirable for internal combustion engine starting devices. Besides this, even if the pressure in the air tank has lowered, the start of the starting device is possible.

What is claimed is:

1. In a pneumatically operated starter for internal combustion engines comprising a pneumatic motor, a driving shaft operatively connected to said pneumatic motor, said driving shaft having at one end a pinion or spline and being movable axially for selectively engaging and disengaging said pinion or spline with gear means of the engine to be started, air piston means for moving axially said driving shaft, main valve means positioned in a main passage of compressed air for controlling flow of compressed air from a supply thereof into said pneumatic motor, sub-valve means positioned in a sub-passage of compressed air communicating with said main passage for controlling flow of compressed air from said main passage into said air piston means, said main valve means and said sub-valve means being actuatable pneumatically by means of their respective air pistons and biassed normally into their closed positions, a first passage branched from said main passage for introducing compressed air to one side of said sub-valve air piston to open said sub-valve, said first passage including a start command valve therein, the improvement comprising, in combination:

a second passage of compressed air for establishing flow communication between said sub-passage and said air piston means in response to the opening of said sub-valve means to advance said driving shaft into the engagement with said engine gear by said pinion or spline, and at the same time for diverting part flow of compressed air to drive said pneumatic motor at low speed;

a third passage of compressed air for establishing flow communication between said air piston means and said main valve air piston in response to the advancement of said air piston means to actuate said main valve air piston to open the main valve for driving said pneumatic motor;

a fourth passage of compressed air for establishing flow communication between said first passage and the other side of said sub-valve air piston opposite to said one side to close said sub-valve means;

third valve means associated with said fourth passage for normally closing the fourth passage, said third valve means having associated therewith an air piston; and a fifth passage of compressed air for establishing flow communication between said third passage and said third valve air piston to open said third valve means with some time delay relative to the opening of said main valve so that compressed air is introduced to said opposite side of said sub-valve air piston whereby said sub-valve means are placed in closed position while said start command valve remains open.

2. The engine starter as claimed in claim 1, wherein said driving shaft circumferentially defines screw splines for operatively engaging mating screw splines defined by a sleeve shaft operatively connected to and driven by said pneumatic motor, and wherein said air piston means comprise a cylindrical housing rigidly carrying an annular piston member thereon and rotatably receiving said driving shaft and said sleeve shaft therein, whereby said pinion or spline is decelerated when the driving shaft is advanced and the driving shaft is retracted when said pinion or spline is accelerated upon starting the engine so that rotational engagement between said driving shaft and the engine gear is automatically disconnected.

3. The engine starter as claimed in claim 2, wherein said fifth passage includes a throttle valve for effecting said time delay in the opening said third valve means relative to the opening of said main valve means.

4. The engine starter as claimed in claim 3, wherein the flow communication between the second passage and the third passage is automatically disconnected by said annular piston member when said driving shaft is retracted by the accelerated rotation of said pinion or spline upon starting the engine.

* * * * *